US011728088B2

(12) United States Patent
Hirukawa

(10) Patent No.: US 11,728,088 B2
(45) Date of Patent: Aug. 15, 2023

(54) MULTILAYER COIL COMPONENT

(71) Applicant: Murata Manufacturing Co., Ltd., Kyoto-fu (JP)

(72) Inventor: Atsuo Hirukawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 338 days.

(21) Appl. No.: 16/197,127

(22) Filed: Nov. 20, 2018

(65) Prior Publication Data

US 2019/0164684 A1 May 30, 2019

(30) Foreign Application Priority Data

Nov. 27, 2017 (JP) ..... 2017-226909

(51) Int. Cl.
*H01F 27/29* (2006.01)
*H01F 27/32* (2006.01)
*H01F 17/00* (2006.01)

(52) U.S. Cl.
CPC ..... *H01F 27/292* (2013.01); *H01F 17/0013* (2013.01); *H01F 27/32* (2013.01)

(58) Field of Classification Search
CPC ..... H01F 2027/2809; H01F 27/2804; H01F 2017/004; H01F 5/003; H01F 17/0013; H01F 27/292
(Continued)

(56) References Cited

U.S. PATENT DOCUMENTS 6,073,339 A * 6/2000 Levin ..... H01F 17/0013 29/602.1
6,165,866 A 12/2000 Kobayashi
(Continued)

FOREIGN PATENT DOCUMENTS

CN 1929050 A * 3/2007 ..... H01F 27/292
CN 106133856 A * 11/2016 ..... H01F 17/04
(Continued)

OTHER PUBLICATIONS

An Office Action; "Notification of Reasons for Refusal," Mailed by the Japanese Patent Office dated Jan. 21, 2020, which corresponds to Japanese Patent Application No. 2017-226909 and is related to U.S. Appl. No. 16/197,127; with English language translation.
(Continued)

*Primary Examiner* — Mang Tin Bik Lian
*Assistant Examiner* — Joselito S. Baisa
(74) *Attorney, Agent, or Firm* — Studebaker & Brackett PC

(57) ABSTRACT

A multilayer coil component includes a multilayer body that is formed of laminated insulating layers and that contains a coil, and a first outer electrode and a second outer electrode that are electrically connected to the coil. The coil is formed of coil conductors. The first outer electrode covers a part of a first end surface of the multilayer body, extends from the first end surface, and covers a part of a first main surface thereof. The second outer electrode covers a part of a second end surface of the multilayer body, extends from the second end surface, and covers a part of the first main surface. A lamination direction of the multilayer body and an axial direction of the coil are parallel to a mounting surface. Determination marks are formed on surfaces of the multilayer body at locations at which the first and second outer electrodes are formed.

9 Claims, 5 Drawing Sheets

(58) Field of Classification Search
USPC ..... 336/208
See application file for complete search history.

(56) References Cited

U.S. PATENT DOCUMENTS 6,218,925 B1 * 4/2001 Iwao ..... H01F 17/0013 336/200
6,577,218 B2 6/2003 Hamatani et al.
6,580,350 B1 6/2003 Kobayashi
7,212,095 B2 5/2007 Sato et al.
7,251,120 B2 7/2007 Takazawa
7,375,977 B2 5/2008 Maeda et al.
7,694,414 B2 4/2010 Maeda et al.
8,159,322 B2 4/2012 Iwasaki et al.
8,618,902 B2 * 12/2013 Nogi ..... H01F 27/29 336/200
8,921,706 B2 * 12/2014 Toda ..... H05K 3/32 174/260
9,343,230 B2 5/2016 Takeuchi et al.
9,412,509 B2 8/2016 Im et al.
10,079,089 B1 * 9/2018 Yoon ..... H05K 1/181
10,475,569 B2 * 11/2019 Yatabe ..... H05K 3/3431
10,720,276 B2 7/2020 Ueyama et al.
10,748,696 B2 * 8/2020 Shibuya ..... H01F 17/045
10,847,307 B1 11/2020 Tajima et al.
10,854,383 B2 * 12/2020 Choi ..... H01F 17/0013
10,998,126 B2 * 5/2021 Nishikawa ..... H01F 41/12
11,217,372 B2 * 1/2022 Jung ..... H01F 5/04
11,605,498 B2 * 3/2023 Kazuta ..... H01F 27/292
2005/0181684 A1 * 8/2005 Ito ..... H05K 3/3442 439/894
2007/0040163 A1 * 2/2007 Okuzawa ..... H01F 27/292 257/31
2010/0253464 A1 * 10/2010 Miyoshi ..... H01F 41/041 336/200
2011/0032066 A1 * 2/2011 Chung ..... H01F 17/0013 336/200
2011/0102969 A1 * 5/2011 Togashi ..... H01G 4/232 29/25.03
2011/0128107 A1 * 6/2011 Kitagawa ..... H01F 27/29 336/192
2012/0062348 A1 3/2012 Hashimoto
2012/0274432 A1 11/2012 Jeong et al.
2013/0187744 A1 7/2013 Seko et al.
2013/0294009 A1 11/2013 Takeuchi et al.
2013/0299215 A1 * 11/2013 Taseda ..... H01G 4/2325 174/255
2014/0159849 A1 6/2014 Bae et al.
2014/0176284 A1 6/2014 Lee et al.
2014/0224418 A1 8/2014 Seko
2014/0300001 A1 * 10/2014 Choi ..... H01L 23/5389 257/774
2014/0311780 A1 * 10/2014 Shizuno ..... H05K 1/0269 174/258
2015/0009003 A1 1/2015 Ozawa et al.
2015/0014040 A1 * 1/2015 Ahn ..... H05K 1/181 361/301.4
2015/0187486 A1 * 7/2015 Lim ..... H01F 17/0013 336/192
2015/0287514 A1 * 10/2015 Lim ..... H01F 17/0033 336/200
2015/0287516 A1 * 10/2015 Park ..... H01F 17/0013 336/192
2015/0371757 A1 12/2015 Takezawa
2016/0268038 A1 * 9/2016 Choi ..... H01F 27/255
2016/0372255 A1 * 12/2016 Maki ..... H01F 27/24
2017/0018351 A1 1/2017 Yatabe et al.
2017/0316867 A1 11/2017 Kamijima et al.
2017/0365419 A1 * 12/2017 Demizu ..... H01G 9/012
2017/0367187 A1 * 12/2017 Chae ..... H05K 1/181
2018/0122557 A1 * 5/2018 Kim ..... H01F 41/041
2018/0166206 A1 6/2018 Ueyama et al.
2019/0115143 A1 * 4/2019 Tachibana ..... H01F 27/292
2019/0164685 A1 5/2019 Hirukawa
2019/0198232 A1 6/2019 Sato et al.
2021/0304950 A1 * 9/2021 Takahashi ..... H01F 27/2804
2022/0122760 A1 * 4/2022 Jung ..... H01F 17/0013

FOREIGN PATENT DOCUMENTS

DE 60035632 T2 * 11/2007 ..... H01G 4/2325
JP H08-335528 A 12/1996
JP H09-129447 A 5/1997
JP H11-307344 A 11/1999
JP 2000-138120 A 5/2000
JP 2001-093730 A 4/2001
JP 2001-196240 A 7/2001
JP 2002-093623 A 3/2002
JP 2002118022 A * 4/2002
JP 2002305111 A * 10/2002
JP 3351738 B2 12/2002
JP 2002367833 A * 12/2002
JP 2003031424 A * 1/2003
JP 2003086425 A * 3/2003
JP 2003-109818 A 4/2003
JP 2004350236 A * 12/2004
JP 2005-322743 A 11/2005
JP 2006-108383 A 4/2006
JP 2012060049 A * 3/2012
JP 2012-227225 A 11/2012
JP 2017-022304 A 1/2017
JP 2017-201761 A 11/2017
JP 2019-096819 A 6/2019
WO WO-2007072617 A1 * 6/2007 ..... H01F 17/0013

OTHER PUBLICATIONS

An Office Action; "Notification of Reasons for Refusal," mailed by the Japanese Patent Office dated Jul. 14, 2020, which corresponds to Japanese Patent Application No. 2018-071003 and is related to U.S. Appl. No. 16/197,127 with English language translation.
An Office Action mailed by the China National Intellectual Property Administration dated Jul. 2, 2020, which corresponds to Chinese Patent Application No. 201811415222.4 and is related to U.S. Appl. No. 16/197,127 with English language translation.
An Office Action mailed by the Japanese Patent Office dated Sep. 15, 2020, which corresponds to Japanese Patent Application No. 2017-226909 and is related to U.S. Appl. No. 16/197,127 with English language translation.
An Office Action mailed by China National Intellectual Property Administration dated May 11, 2021 which corresponds to Chinese Patent Application No. 201811415222.4 and is related to U.S. Appl. No. 16/197,127 with English language translation.
An Office Action; "Notice of Reasons for Refusal," mailed by the Japanese Patent Office dated Oct. 5, 2021, which corresponds to Japanese Patent Application No. 2020-173331 and is related to U.S. Appl. No. 16/197,127 with English translation.

* cited by examiner

MULTILAYER COIL COMPONENT

CROSS-REFERENCE TO RELATED APPLICATION

This application claims benefit of priority to Japanese Patent Application No. 2017-226909, filed Nov. 27, 2017, the entire content of which is incorporated herein by reference.

BACKGROUND

Technical Field

The present disclosure relates to a multilayer coil component.

Background Art

A multilayer inductor that is disclosed, as an example of multilayer coil components, in Japanese Unexamined Patent Application Publication No. 9-129447 is formed of coil conductors and insulating members that are laminated. The multilayer inductor disclosed in Japanese Unexamined Patent Application Publication No. 9-129447 is characterized in that the axial direction of a coil that is formed of the coil conductors that are electrically connected to each other is perpendicular to outer electrodes to which end portions of the coil are electrically connected, and a lamination direction of a multilayer body that is formed of the coil conductors and the insulating members is perpendicular to the outer electrodes.

SUMMARY

The multilayer body of the multilayer inductor disclosed in Japanese Unexamined Patent Application Publication No. 9-129447 is obtained by laminating insulating sheets that include the coil conductors. The coil conductors are connected in series with each other via through-holes and form the coil. The lamination direction of the insulating sheets is parallel to a mounting surface and is perpendicular to the outer electrodes. The axial direction of the coil is parallel to the mounting surface and is perpendicular to the outer electrodes.

The multilayer inductor disclosed in Japanese Unexamined Patent Application Publication No. 9-129447 can allegedly decrease a stray capacitance between the coil and each outer electrode because the axial direction of the coil is perpendicular to the outer electrode.

In the case where an attempt is made to further decrease the stray capacitance between the coil and each outer electrode, the outer electrode is formed on a part of an end surface or a part of a side surface of the multilayer body to decrease the area of the outer electrode that faces the coil. However, when each outer electrode is formed on the part of the end surface or the part of the side surface of the multilayer body, visual inspection of the upper and lower surfaces, the side surfaces, and the end surfaces of the multilayer body is not enough to determine a location at which the outer electrode is to be formed. Accordingly, it is also difficult to achieve automatic determination with, for example, a sensor.

The present disclosure thus provides a multilayer coil component that enables the location at which the outer electrode is to be formed to be readily determined.

According to preferred embodiments of the present disclosure, a multilayer coil component includes a multilayer body that is formed of laminated insulating layers and that contains a coil, and a first outer electrode and a second outer electrode that are electrically connected to the coil. The coil is formed of coil conductors that are stacked together with the insulating layers and that are electrically connected to each other. The multilayer body has a first end surface and a second end surface that face away from each other in a length direction, a first main surface and a second main surface that face away from each other in a height direction perpendicular to the length direction, and a first side surface and a second side surface that face away from each other in a width direction perpendicular to the length direction and the height direction. The first outer electrode covers a part of the first end surface, extends from the first end surface, and covers a part of the first main surface. The second outer electrode covers a part of the second end surface, extends from the second end surface, and covers a part of the first main surface. The first main surface serves as a mounting surface. A lamination direction of the multilayer body and an axial direction of the coil are parallel to the mounting surface. A determination mark is formed on a surface of the multilayer body at a location at which the first outer electrode or the second outer electrode is formed.

According to preferred embodiments of the present disclosure, it is preferable that the multilayer body contain a first connection conductor and a second connection conductor. The first connection conductor linearly connects a part of the first outer electrode that covers the first end surface and one of the coil conductors that faces the part of the first outer electrode to each other, and the second connection conductor linearly connects a part of the second outer electrode that covers the second end surface and another of the coil conductors that faces the part of the second outer electrode to each other. Also, the first connection conductor and the second connection conductor overlap the coil conductors in a plan view along the lamination direction and are nearer than a central axis of the coil to the mounting surface.

According to preferred embodiments of the present disclosure, the first outer electrode may further extend from the first end surface and the first main surface and cover a part of the first side surface and a part of the second side surface. Also, the second outer electrode may further extend from the second end surface and the first main surface and cover a part of the first side surface and a part of the second side surface.

According to preferred embodiments of the present disclosure, the determination mark is preferably formed of a mark conductor pattern that is formed on one of the insulating layers, and the mark conductor pattern is preferably in contact with an outer circumferential edge of the one of the insulating layers. According to preferred embodiments of the present disclosure, the determination mark is preferably formed on the first main surface of the multilayer body.

According to preferred embodiments of the present disclosure, the determination mark is preferably provided in a plurality and the determination marks are formed in at least two regions each of which contains a corner of the first main surface such that each determination mark is composed of a line or a plurality of lines and are more preferably formed in four regions. The determination marks are preferably symmetric with each other with respect to a point.

According to preferred embodiments of the present disclosure, the length of the line is preferably no less than 0.04 mm and no more than 0.1 mm (i.e., from 0.04 mm to 0.1 mm). According to preferred embodiments of the present disclosure, a multilayer coil component that enables the location at which the outer electrode is to be formed to be readily determined.

Other features, elements, characteristics and advantages of the present disclosure will become more apparent from the following detailed description of preferred embodiments of the present disclosure with reference to the attached drawings.

DETAILED DESCRIPTION

A multilayer coil component according to an embodiment of the present disclosure will hereinafter be described.

The present disclosure, however, is not limited to the embodiment described below and can be appropriately changed and carried out without departing from the spirit of the present disclosure. The present disclosure includes a combination of two or more preferable features described below.

Figure 1:
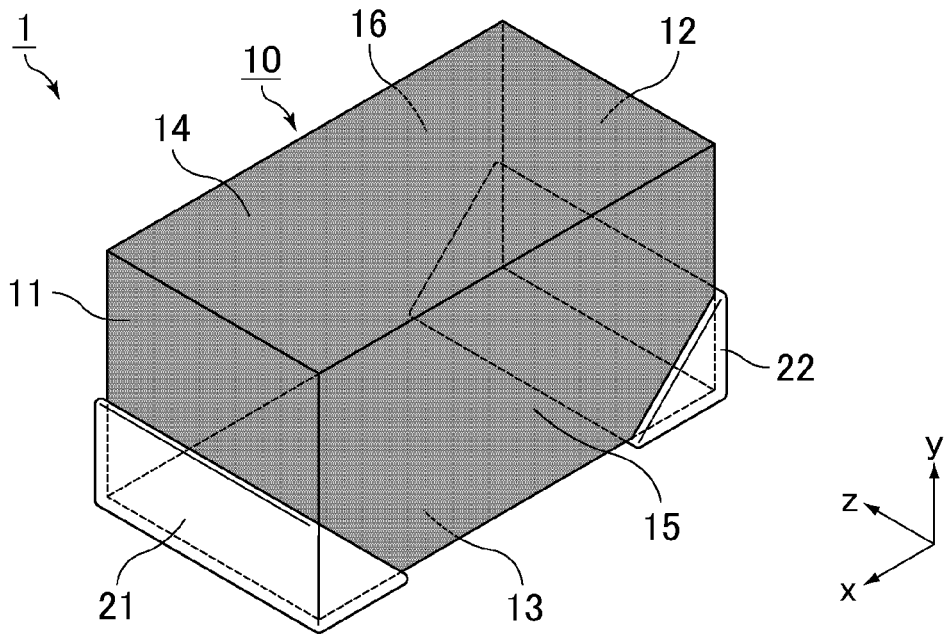
FIG. 1 schematically illustrates a perspective view of a multilayer coil component according to an embodiment of the present disclosure.
Figure 2A:
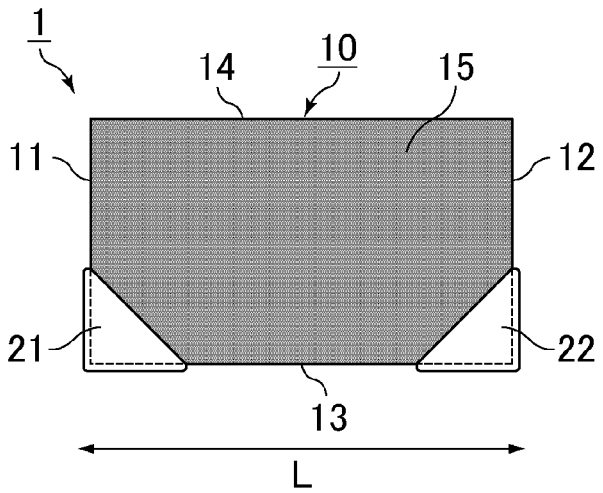
FIG. 2A is a side view of the multilayer coil component illustrated in FIG. 1.
Figure 2B:
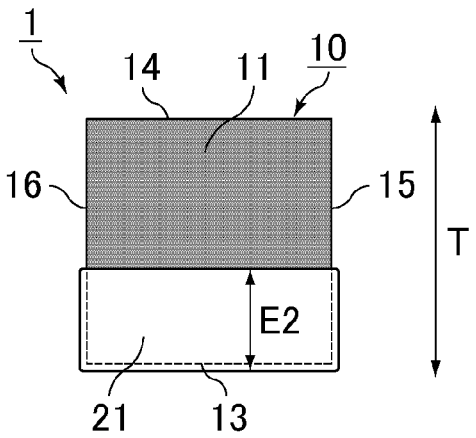
FIG. 2B is a front view of the multilayer coil component illustrated in FIG. 1.
Figure 2C:
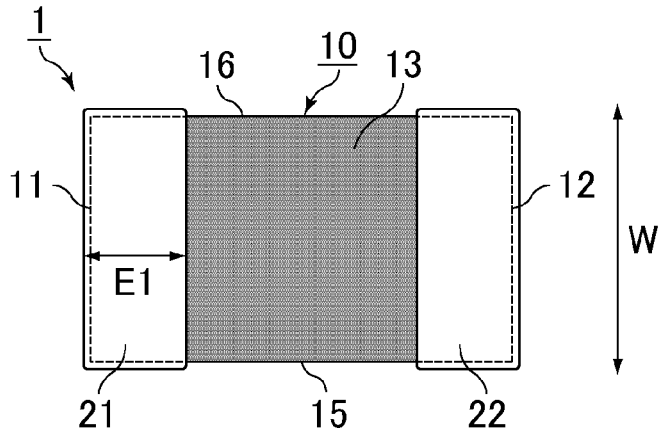
FIG. 2C is a bottom view of the multilayer coil component illustrated in FIG. 1.

FIG. 1 schematically illustrates a perspective view of the multilayer coil component according to the embodiment of the present disclosure. FIG. 2A is a side view of the multilayer coil component illustrated in FIG. 1. FIG. 2B is a front view of the multilayer coil component illustrated in FIG. 1. FIG. 2C is a bottom view of the multilayer coil component illustrated in FIG. 1.

The multilayer coil component that is designated as 1 in FIG. 1, FIG. 2A, FIG. 2B, and FIG. 2C includes a multilayer body 10, a first outer electrode 21, and a second outer electrode 22. The multilayer body 10 has a substantially rectangular cuboid shape having six surfaces. The multilayer body 10 is formed of laminated insulating layers and contains a coil, and the structure thereof will be described later. The first outer electrode 21 and the second outer electrode 22 are electrically connected to the coil.

The length direction, the height direction, and the width direction of the multilayer coil component and the multilayer body 10 according to the embodiment of the present disclosure correspond to the x-direction, the y-direction, and the z-direction in FIG. 1, respectively. The length direction (x-direction), the height direction (y-direction), and the width direction (z-direction) are perpendicular to each other.

As illustrated in FIG. 1, FIG. 2A, FIG. 2B, and FIG. 2C, the multilayer body 10 has a first end surface 11 and a second end surface 12 that face away from each other in the length direction (x-direction), a first main surface 13 and a second main surface 14 that face away from each other in the height direction (y-direction) perpendicular to the length direction, and a first side surface 15 and a second side surface 16 that face away from each other in the width direction (z-direction) perpendicular to the length direction and the height direction. The multilayer body 10 preferably has rounded corners and rounded ridges although this is not illustrated. At each corner, three surfaces of the multilayer body meet. Along each ridge, two surfaces of the multilayer body meet.

As illustrated in FIG. 1 and FIG. 2B, the first outer electrode 21 covers a part of the first end surface 11 of the multilayer body 10. As illustrated in FIG. 1 and FIG. 2C, the first outer electrode 21 extends from the first end surface 11 and covers a part of the first main surface 13. As illustrated in FIG. 2B, the first outer electrode 21 covers a region of the first end surface 11 that contains the ridge along which the first end surface 11 and the first main surface 13 meet but does not cover a region that contains the ridge along which the first end surface 11 and the second main surface 14 meet. Accordingly, a part of the first end surface 11 is exposed at the region that contains the ridge along which the first end surface 11 and the second main surface 14 meet. The first outer electrode 21 does not cover the second main surface 14.

In FIG. 2B, a part of the first outer electrode 21 that covers the first end surface 11 of the multilayer body 10 has a constant height. The shape of the first outer electrode 21 is not particularly limited, provided that the first outer electrode 21 covers the part of the first end surface 11 of the multilayer body 10. For example, the part of the first outer electrode 21 on the first end surface 11 of the multilayer body 10 may have a substantially arching shape that bulges from end portions toward a central portion. In FIG. 2C, a part of the first outer electrode 21 that covers the first main surface 13 of the multilayer body 10 has a constant length. The shape of the first outer electrode 21 is not particularly limited, provided that the first outer electrode 21 covers the part of the first main surface 13 of the multilayer body 10. For example, the part of the first outer electrode 21 on the first main surface 13 of the multilayer body 10 may have a substantially arching shape that bulges from end portions toward a central portion.

As illustrated in FIG. 1 and FIG. 2A, the first outer electrode 21 may further extend from the first end surface 11 and the first main surface 13 and cover a part of the first side surface 15 and a part of the second side surface 16. In this case, as illustrated in FIG. 2A, the parts of the first outer electrode 21 that cover the first side surface 15 and the second side surface 16 are preferably formed at an angle with respect to the ridges along which the first side surface 15 and the second side surface 16 meet the first end surface 11 and the first main surface 13. The first outer electrode 21 may not cover the part of the first side surface 15 and the part of the second side surface 16.

The second outer electrode 22 covers a part of the second end surface 12 of the multilayer body 10, extends from the second end surface 12, and covers a part of the first main surface 13. The second outer electrode 22 covers a region of the second end surface 12 that contains the ridge along which the second end surface 12 and the first main surface 13 meet but does not cover a region that contains the ridge along which the second end surface 12 and the second main surface 14 meet as in the first outer electrode 21. Accordingly, a part of the second end surface 12 is exposed at the region that contains along which the second end surface 12 and the second main surface 14 meet. The second outer electrode 22 does not cover the second main surface 14.

The shape of the second outer electrode 22 is not particularly limited, provided that the second outer electrode 22 covers the part of the second end surface 12 of the multilayer body 10 as in the first outer electrode 21. For example, a part of the second outer electrode 22 on the second end surface 12 of the multilayer body 10 may have a substantially arching shape that bulges from end portions toward a central portion. The shape of the second outer electrode 22 is not particularly limited, provided that the second outer electrode 22 covers the part of the first main surface 13 of the multilayer body 10. For example, a part of the second outer electrode 22 on the first main surface 13 of the multilayer body 10 may have a substantially arching shape that bulges from end portions toward a central portion.

The second outer electrode 22 may further extend from the second end surface 12 and the first main surface 13 and cover a part of the first side surface 15 and a part of the second side surface 16 as in the first outer electrode 21. In this case, the parts of the second outer electrode 22 that cover the first side surface 15 and the second side surface 16 are preferably formed at an angle with respect to the ridges along which the first side surface 15 and the second side surface 16 meet the second end surface 12 and the first main surface 13. The second outer electrode 22 may not cover the part of the first side surface 15 and the part of the second side surface 16.

Since the first outer electrode 21 and the second outer electrode 22 are thus arranged, when a multilayer coil component 1 is mounted on a substrate, the first main surface 13 of the multilayer body 10 serves as a mounting surface. The size of the multilayer coil component according to the embodiment of the present disclosure is not particularly limited but is preferably 0603 size or 0402 size so-called in the industry.

When the size of the multilayer coil component according to the embodiment of the present disclosure is the 0603 size, the length (length represented by a double-headed arrow L in FIG. 2A) of the multilayer coil component is preferably no less than 0.57 mm and no more than 0.63 mm (i.e., from 0.57 mm to 0.63 mm), and the width (length represented by a double-headed arrow W in FIG. 2C) of the multilayer coil component is preferably no less than 0.27 mm and no more than 0.33 mm (i.e., from 0.27 mm to 0.33 mm).

When the size of the multilayer coil component according to the embodiment of the present disclosure is the 0603 size, the height (length represented by a double-headed arrow T in FIG. 2B) of the multilayer coil component is preferably no less than 0.27 mm and no more than 0.33 mm (i.e., from 0.27 mm to 0.33 mm). When the size of the multilayer coil component according to the embodiment of the present disclosure is the 0603 size, the length (length represented by a double-headed arrow E1 in FIG. 2C) of the part of the first outer electrode 21 that covers the first main surface 13 of the multilayer body 10 is preferably no less than 0.12 mm and no more than 0.22 mm (i.e., from 0.12 mm to 0.22 mm). Similarly, the length of the part of the second outer electrode 22 that covers the first main surface 13 of the multilayer body 10 is preferably no less than 0.12 mm and no more than 0.22 mm (i.e., from 0.12 mm to 0.22 mm).

When the length of the part of the first outer electrode 21 that covers the first main surface 13 of the multilayer body 10 and the length of the part of the second outer electrode 22 that covers the first main surface 13 of the multilayer body 10 are not constant, the maximum length is preferably within the above range.

When the size of the multilayer coil component according to the embodiment of the present disclosure is the 0603 size, the height (length represented by a double-headed arrow E2 in FIG. 2B) of the part of the first outer electrode 21 that covers the first end surface 11 of the multilayer body 10 is preferably no less than 0.1 mm and no more than 0.2 mm (i.e., from 0.1 mm to 0.2 mm). Similarly, the height of the part of the second outer electrode 22 that covers the second end surface 12 of the multilayer body 10 is preferably no less than 0.1 mm and no more than 0.2 mm (i.e., from 0.1 mm to 0.2 mm). In this case, a stray capacitance due to each outer electrode can be decreased.

The height of the part of the first outer electrode 21 that covers the first end surface 11 of the multilayer body 10 and the height of the part of the second outer electrode 22 that covers the second end surface 12 of the multilayer body 10 are not constant, the maximum height is preferably within the above range.

When the size of the multilayer coil component according to the embodiment of the present disclosure is the 0402 size, the length of the multilayer coil component is preferably no less than 0.38 mm and no more than 0.42 mm (i.e., from 0.38 mm to 0.42 mm), and the width of the multilayer coil component is preferably no less than 0.18 mm and no more than 0.22 mm (i.e., from 0.18 mm to 0.22 mm). When the size of the multilayer coil component according to the embodiment of the present disclosure is the 0402 size, the height of the multilayer coil component is preferably no less than 0.18 mm and no more than 0.22 mm (i.e., from 0.18 mm to 0.22 mm).

When the size of the multilayer coil component according to the embodiment of the present disclosure is the 0402 size, the length of the part of the first outer electrode 21 that covers the first main surface 13 of the multilayer body 10 is preferably no less than 0.08 mm and no more than 0.15 mm (i.e., from 0.08 mm to 0.15 mm). Similarly, the length of the part of the second outer electrode 22 that covers the first main surface 13 of the multilayer body 10 is preferably no less than 0.08 mm and no more than 0.15 mm (i.e., from 0.08 mm to 0.15 mm).

When the size of the multilayer coil component according to the embodiment of the present disclosure is the 0402 size, the height of the part of the first outer electrode 21 that covers the first end surface 11 of the multilayer body 10 is preferably no less than 0.06 mm and no more than 0.13 mm (i.e., from 0.06 mm to 0.13 mm). Similarly, the height of the part of the second outer electrode 22 that covers the second end surface 12 of the multilayer body 10 is preferably no less than 0.06 mm and no more than 0.13 mm (i.e., from 0.06 mm to 0.13 mm). In this case, the stray capacitance due to each outer electrode can be decreased.

Figure 3:
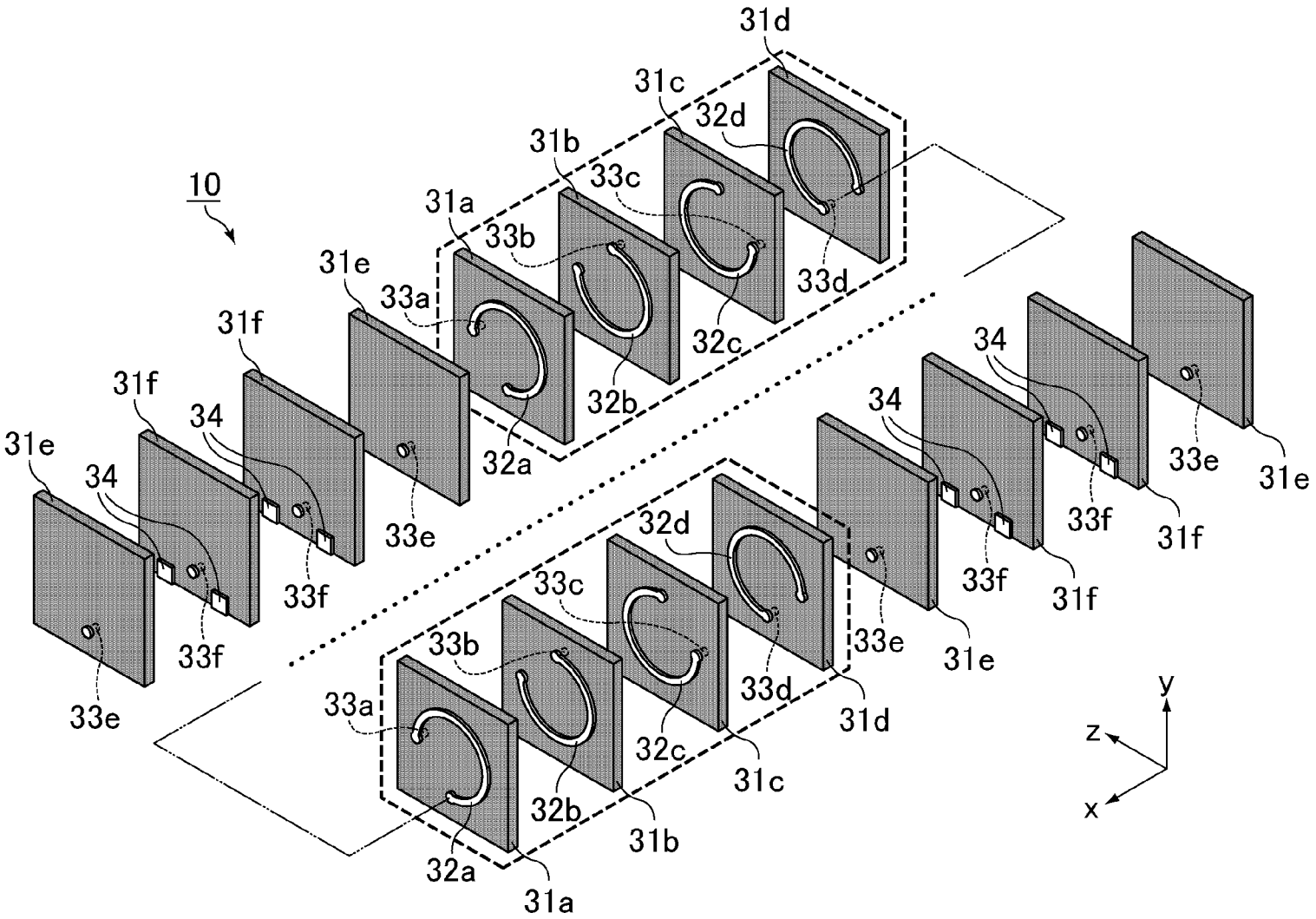
FIG. 3 schematically illustrates an exploded perspective view of an example of a multilayer body that is included in the multilayer coil component illustrated in FIG. 1.
Figure 4:
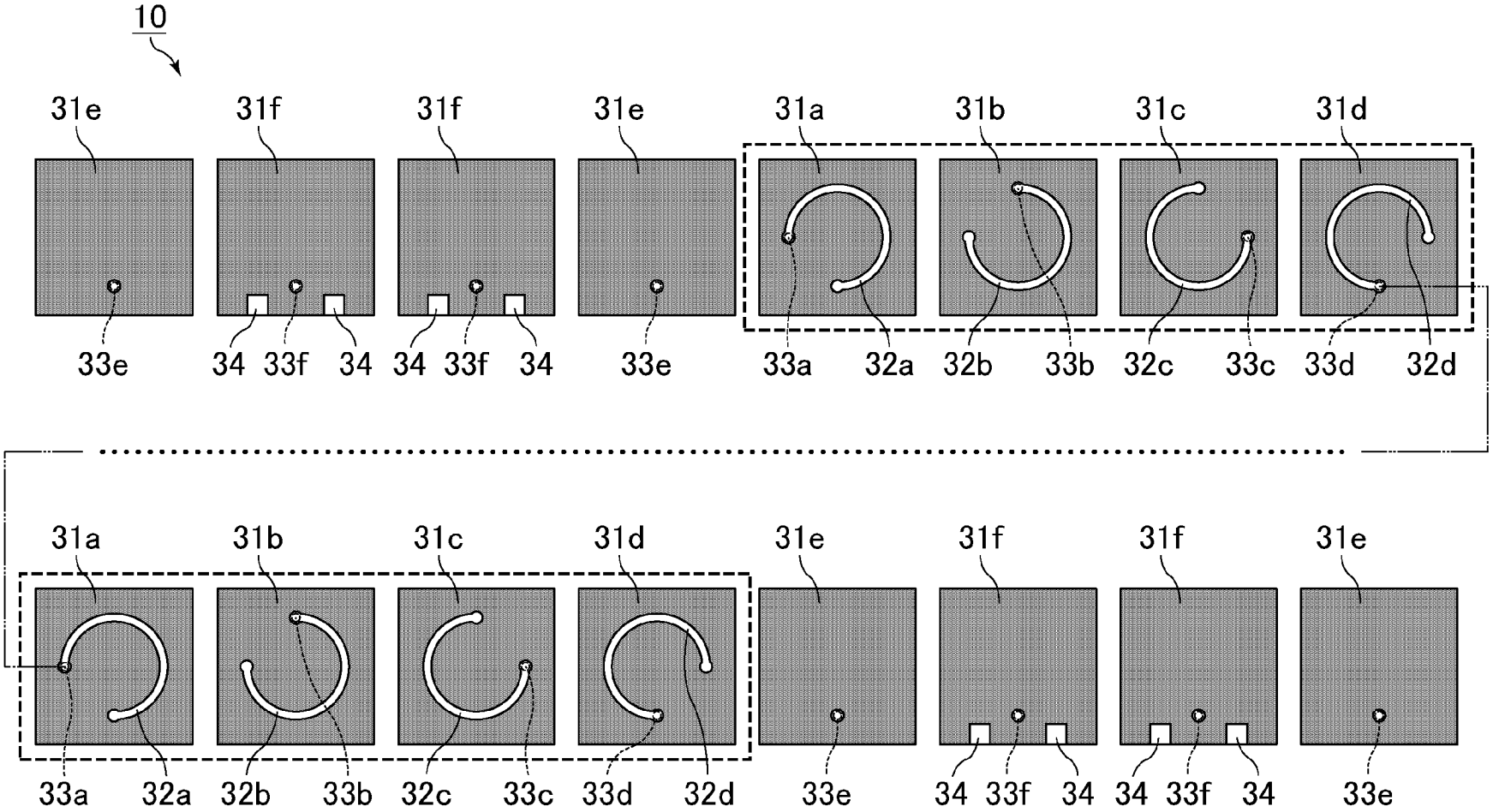
FIG. 4 schematically illustrates an exploded plan view of the example of the multilayer body that is included in the multilayer coil component illustrated in FIG. 1.

FIG. 3 schematically illustrates an exploded perspective view of an example of the multilayer body 10 that is included in the multilayer coil component illustrated in FIG. 1. FIG. 4 schematically illustrates an exploded plan view of the example of the multilayer body 10 that is included in the multilayer coil component illustrated in FIG. 1.

As illustrated in FIG. 3 and FIG. 4, the multilayer body 10 is formed of insulating layers 31*a*, 31*b*, 31*c*, 31*d*, 31*e*, and 31*f* that are laminated in the length direction (x-direction). The direction in which the insulating layers that are included in the multilayer body 10 are laminated is referred to as a lamination direction.

The insulating layers 31*a*, 31*b*, 31*c*, and 31*d* include respective coil conductors 32*a*, 32*b*, 32*c*, and 32*d*, and respective via conductors 33*a*, 33*b*, 33*c*, and 33*d*. Each insulating layer 31*e* include a via conductor 33*e*. Each insulating layer 31*f* includes a via conductor 33*f* and mark conductor patterns 34.

The coil conductors 32*a*, 32*b*, 32*c*, and 32*d* are disposed on main surfaces of the corresponding insulating layers 31*a*, 31*b*, 31*c*, and 31*d* and are stacked together with the insulating layers 31*a*, 31*b*, 31*c*, 31*d*, 31*e*, and 31*f*. As illustrated in FIG. 3 and FIG. 4, each coil conductor has a ¾ turn shape and is stacked, and a combination of the insulating layers 31*a*, 31*b*, 31*c*, and 31*d* is regarded as a unit (for three turns).

The via conductors 33*a*, 33*b*, 33*c*, 33*d*, 33*e*, and 33*f* extend through the insulating layers 31*a*, 31*b*, 31*c*, 31*d*, 31*e*, and 31*f* in the thickness direction (x-direction in FIG. 3), respectively. Lands that are connected to the via conductors are typically disposed on the main surfaces of the insulating layers. The size of each land is preferably slightly more than the line width of each coil conductor.

The mark conductor patterns 34 are formed on the main surfaces of the insulating layers 31*f*. In FIG. 3 and FIG. 4, the mark conductor patterns 34 are formed in two regions of the main surface of each insulating layer 31*f* and are in contact with an outer circumferential edge of the insulating layer 31*f*.

The insulating layers 31*a*, 31*b*, 31*c*, 31*d*, 31*e*, and 31*f* that have the above structure are laminated in the X-direction as illustrated in FIG. 3. Thus, the coil conductors 32*a*, 32*b*, 32*c*, and 32*d* are electrically connected to each other with the via conductors 33*a*, 33*b*, 33*c*, and the 33*d* interposed therebetween. Consequently, a solenoid coil that has a coil axis extending in the x-direction is formed in the multilayer body 10.

In the multilayer body 10, the via conductors 33*e* and 33*f* form connection conductors, which are exposed from respective end surfaces of the multilayer body 10. In the multilayer body 10, each connection conductor linearly connects the first outer electrode 21 and the coil conductor 32*a* that faces the first outer electrode 21 or linearly connects the second outer electrode 22 and the coil conductor 32*d* that faces the second outer electrode 22. The mark conductor patterns 34 are exposed from the first main surface 13 of the multilayer body 10 and serve as determination marks 50.

Figure 5A:
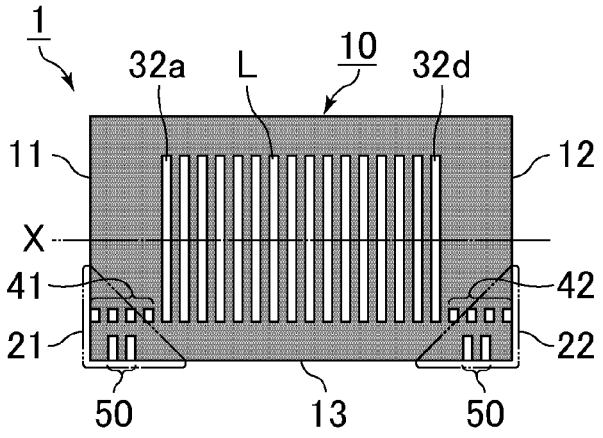
FIG. 5A schematically illustrates a side view of an example of an internal structure of the multilayer body that is included in the multilayer coil component according to the embodiment of the present disclosure.
Figure 5B:
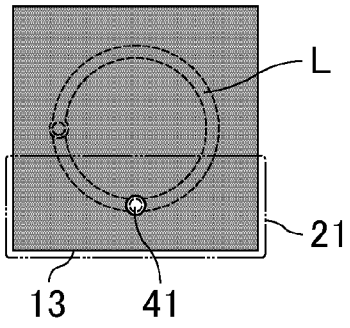
FIG. 5B schematically illustrates a front view of an example of a first end surface of the multilayer body that is included in the multilayer coil component according to the embodiment of the present disclosure.
Figure 5C:
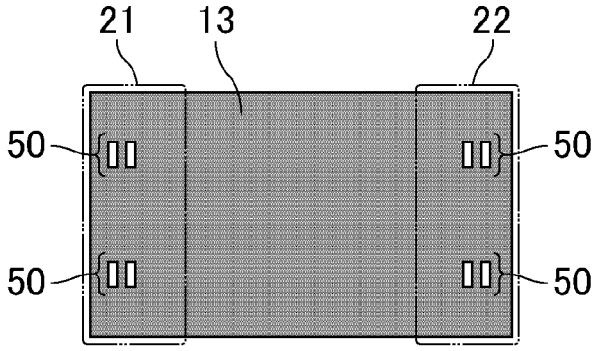
FIG. 5C schematically illustrates a bottom view of an example of a first main surface of the multilayer body that is included in the multilayer coil component according to the embodiment of the present disclosure.

FIG. 5A schematically illustrates a side view of an example of an internal structure of the multilayer body 10 that is included in the multilayer coil component according to the embodiment of the present disclosure. FIG. 5B schematically illustrates a front view of an example of the first end surface 11 of the multilayer body 10 that is included in the multilayer coil component according to the embodiment of the present disclosure. FIG. 5C schematically illustrates a bottom view of an example of the first main surface 13 of the multilayer body 10 that is included in the multilayer coil component according to the embodiment of the present disclosure. FIG. 5A schematically illustrates the positional relationship among the coil, the connection conductors, and the determination marks 50, and the lamination direction of the multilayer body 10 but does not strictly illustrate actual shapes and connections. For example, the coil conductors that form the coil are connected to each other with the via conductors interposed therebetween. The via conductors that form the connection conductors are connected to each other.

As illustrated in FIG. 5A, the lamination direction of the multilayer body 10 of the multilayer coil component 1 and the axial direction of a coil L (corresponding to the central axis X of the coil L in FIG. 5A) are parallel to the first main surface 13 that serves as the mounting surface. In the multilayer body 10, a first connection conductor 41 linearly connects the part of the first outer electrode 21 that covers the first end surface 11 and the coil conductor 32*a* that faces the first outer electrode 21. Similarly, in the multilayer body 10, a second connection conductor 42 linearly connects the part of the second outer electrode 22 that covers the second end surface 12 and the coil conductor 32*d* that faces the second outer electrode 22.

As a result of the coil and the outer electrodes being linearly connected, extended portions can be simple, and the high-frequency characteristics can be improved. In the case where the via conductors that form the connection conductors overlap in a plan view from the lamination direction, the via conductors that form the connection conductors may not be strictly arranged linearly.

As illustrated in FIG. 5B, the first connection conductor 41 overlaps the coil conductors that form the coil L in a plan view from the lamination direction. As illustrated in FIG. 5A, the first connection conductor 41 is nearer than the central axis X of the coil L to the first main surface 13 that serves as the mounting surface. Similarly, the second connection conductor 42 overlaps the coil conductors that form the coil L in a plan view from the lamination direction and is nearer than the central axis X of the coil L to the first main surface 13 that serves as the mounting surface.

In FIG. 5A and FIG. 5B, the first connection conductor 41 and the second connection conductor 42 overlap the coil conductors that form the coil L in a plan view from the lamination direction so as to be nearest to the first main surface 13. However, the position of the first connection conductor 41 is not particularly limited, provided that the first connection conductor 41 overlaps the coil conductors that form the coil L in a plan view from the lamination direction and is connected to the first outer electrode 21. Similarly, the position of the second connection conductor 42 is not particularly limited, provided that the second connection conductor 42 overlaps the coil conductors that form the coil L in a plan view from the lamination direction and is connected to the second outer electrode 22. In FIG. 5A, the first connection conductor 41 and the second connection conductor 42 overlap in a plan view from the lamination direction. However, the first connection conductor 41 and the second connection conductor 42 may not overlap.

As illustrated in FIG. 5B, the coil conductors that form the coil L preferably overlap in a plan view from the lamination direction. The shape of the coil L in a plan view from the lamination direction is preferably substantially circular. When the coil L includes the lands, the shape of the coil L means the shape except for the lands.

Determination marks 50 are formed at locations of a surface of the multilayer body 10 at which the first outer electrode 21 and the second outer electrode 22 are formed. In FIG. 5A and FIG. 5C, the determination marks 50 are formed on the first main surface 13 of the multilayer body 10.

The determination marks 50 that are formed on the surface of the multilayer body 10 enable locations at which the outer electrodes are to be formed to be readily determined. This enables automatic determination with, for example, a sensor.

The determination marks 50 are preferably formed on the first main surface 13 of the multilayer body 10. However, the determination marks 50 may be formed on the first end surface 11 or the second end surface 12 or may be formed on the first side surface or the second side surface, provided that the locations thereof are the same as the locations at which the first outer electrode 21 and the second outer electrode 22 are formed.

In an example illustrated in FIG. 5C, the determination marks 50 are formed in four regions each of which contains a corresponding one of the corners of the first main surface 13 such that each determination mark is composed of two lines. Each determination mark may be composed of one line or three lines or more. In the case where the determination marks 50 are formed at plural regions, the number of the lines of each determination mark may be the same or may differ.

Figure 6:
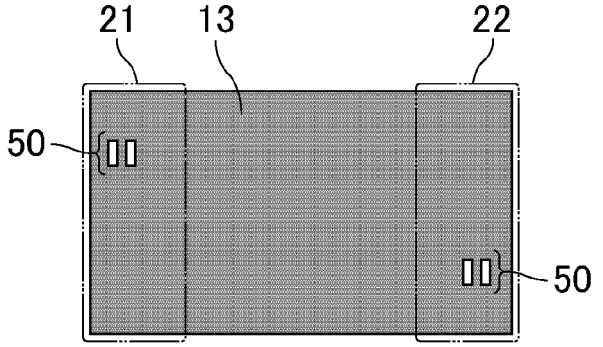
FIG. 6 schematically illustrates a bottom view of another example of the first main surface of the multilayer coil component according to the embodiment of the present disclosure.

FIG. 6 schematically illustrates a bottom view of another example of the first main surface 13 that the multilayer coil component according to the embodiment of the present disclosure has. In an example illustrated in FIG. 6, the determination marks 50 are formed in two regions each of which contains the respective two corners of the first main surface 13.

As illustrated in FIG. 6, the determination marks 50 are preferably symmetric with each other with respect to a point. When the determination marks 50 are symmetric with each other with respect to a point, a turn of the multilayer body 10 does not change the arrangement of the determination marks 50, and an accurate determination rate during automatic determination can be inhibited from decreasing.

The length (dimension in the width direction of the multilayer body 10) of the lines of the determination marks 50 is not particularly limited but is preferably no less than 0.04 mm and no more than 0.1 mm (i.e., from 0.04 mm to 0.1 mm). The width (dimension in the length direction of the multilayer body 10) and shape of the lines, for example, are not particularly limited.

The determination marks 50 may be formed on the insulating layers so as to be exposed from a surface of the multilayer body 10 or may be formed on the surface of the multilayer body 10 after the insulating layers are laminated. However, the determination marks 50 are preferably formed on the insulating layers. In other words, the determination marks 50 preferably extend from the inside of the multilayer body 10 and are preferably formed on the surface of the multilayer body 10.

In particular, each determination mark is preferably formed of a conductor pattern that is formed on the corresponding insulating layer. In this case, the conductor pattern is formed so as to be in contact with an outer circumferential edge of the insulating layer. This enables a contact portion of the conductor pattern to be exposed from the multilayer body 10, and the determination mark can be readily formed. The material of each determination mark is not particularly limited, and examples thereof may include a nonconductive material such as a ceramic material.

The structure of the multilayer body 10 of the multilayer coil component according to the embodiment of the present disclosure is not limited to the structure illustrated in FIG. 3 and FIG. 4. For example, the shape of the coil conductors that are included in the insulating layers 31*a*, 31*b*, 31*c*, and 31*d* or the shape of the mark conductor patterns that are included in the insulating layers 31*f* can be appropriately changed. The number and order of the insulating layers 31*e* and 31*f* that are laminated outside the coil can be appropriately changed. The insulating layers 31*e* are not essential.

When the size of the multilayer coil component according to the embodiment of the present disclosure is the 0603 size, the distance between the coil conductors in the lamination direction is preferably no less than 3 μm and no more than 7 μm (i.e., from 3 μm to 7 μm). When the distance between the coil conductors in the lamination direction is no less than 3 μm and no more than 7 μm (i.e., from 3 μm to 7 μm), the number of turns of the coil can be increased, an electrostatic capacity between the coil conductors decreases, and the impedance can be increased. In addition, a transmission coefficient S21 at high frequencies, described later, can be decreased.

The multilayer coil component according to the embodiment of the present disclosure preferably includes the first connection conductor and the second connection conductor described above. The multilayer coil component has excellent high-frequency characteristics in a high frequency band, particularly, in a band of no less than 30 GHz and no more than 80 GHz (i.e., from 30 GHz to 80 GHz). Accordingly, the multilayer coil component is preferably used for, for example, a bias-tee circuit in an optical communication circuit.

The transmission coefficient S21 at about 40 GHz is evaluated as the high-frequency characteristics of the multilayer coil component according to the embodiment of the present disclosure. The transmission coefficient S21 is calculated from a ratio of power of a transmission signal to an input signal. The transmission coefficient S21 is basically a dimensionless quantity and is typically expressed by a unit of dB with a common logarithm. The transmission coefficient S21 of the multilayer coil component according to the embodiment of the present disclosure at about 40 GHz is preferably no less than −1.0 dB and no more than 0 dB (i.e., from −1.0 dB to 0 dB).

An example of a method of manufacturing the multilayer coil component according to the embodiment of the present disclosure will now be described.

A ceramic green sheet for the insulating layers is first manufactured. For example, an organic binder such as a polyvinyl butyral resin, an organic solvent such as ethanol or toluene, and a dispersant are added in a ferrite material and kneaded to form a slurry. Subsequently, a magnetic sheet having a thickness of about 12 μm is obtained by, for example, a doctor blade method.

After oxidizable materials such as iron, nickel, zinc, and copper are mixed as ferrite materials and are pre-fired at about 800° C. for about 1 hour, the materials are pulverized with a ball mill and dried. Consequently, a Ni—Zn—Cu ferrite material (powder of mixed oxides) having an average particle diameter of about 2 μm can be obtained.

Examples of the material of the ceramic green sheet for the insulating layers can include a magnetic material such as a ferrite material, and a non-magnetic material such as a glass ceramic material, and a mixed material of these magnetic materials and/or the non-magnetic materials. When the ceramic green sheet is manufactured with a ferrite material, to achieve a high L value (inductance), the ceramic green sheet is preferably manufactured with a ferrite material that is composed of $Fe_2O_3$ in an amount of no less than 40 mol % and no more than 49.5 mol % (i.e., from 40 mol % to 49.5 mol %), ZnO in an amount of no less than 5 mol % and no more than 35 mol % (i.e., from 5 mol % to 35 mol %), CuO in an amount of no less than 4 mol % and no more than 12 mol % (i.e., from 4 mol % to 12 mol %), and a rest of NiO and a small amount of additive (containing inevitable impurities).

Via holes having a diameter of no less than about 20 μm and no more than about 30 μm (i.e., from about 20 μm to about 30 μm) are formed in the manufactured ceramic green sheet by a predetermined laser process. A via hole that is formed in a specific sheet is filled with an Ag paste. Conductor patterns (coil conductors) each having a thickness of about 11 μm for coil circling with ¾ turns are formed by screen printing. After drying, coil sheets are obtained.

After cutting, the coil sheets are stacked such that the coil having a winding axis parallel to the mounting surface is formed in a multilayer body 10. The via conductors that form the connection conductors are formed in via sheets, and the via sheets are stacked. At least one of the sheets includes the mark conductor pattern for the mark as needed.

After the multilayer body 10 is subjected to thermo-compression bonding to obtain a bonded body having a thickness of about 0.67 mm, the bonded body is cut with chip dimensions of a length of about 0.67 mm, a width of about 0.34 mm, a height of about 0.34 mm to obtain individual chips. The individual chips may be processed with a rotating barrel to round the corners and ridges thereof.

A fired body (multilayer body) that contains the coil is obtained by a binder removing process and a firing process at a predetermined temperature for a period of time each.

An Ag paste is elongated to have a predetermined thickness to form a layer, and the chip is obliquely inserted into the layer and baked to form underlying electrodes for the outer electrodes on four surfaces (a main surface, an end surface, and side surfaces) of the multilayer body 10.

The above method enables the underlying electrodes to be formed at a time unlike the case where the underlying electrodes are formed on the main surface and end surface of the multilayer body 10 at two times.

Ni films and Sn films that have predetermined thicknesses are successively formed on the underlying electrodes by plating to form the outer electrodes. In this way, the multilayer coil component according to the embodiment of the present disclosure can be manufactured.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body that is formed of laminated insulating layers and that contains a coil, each laminated insulating layer having a respective primary surface; and a first outer electrode and a second outer electrode that are electrically connected to the coil, wherein the coil is formed of coil conductors that are stacked together with the insulating layers and that are electrically connected to each other, the coil conductors each being disposed on respective primary surfaces of one group of the laminated insulating layers, the multilayer body has a first end surface and a second end surface that face away from each other in a length direction, a first main surface and a second main surface that face away from each other in a height direction perpendicular to the length direction, and a first side surface and a second side surface that face away from each other in a width direction perpendicular to the length direction and the height direction, the first outer electrode covers a part of the first end surface, extends from the first end surface, and covers a part of the first main surface, the second outer electrode covers a part of the second end surface, extends from the second end surface, and covers a part of the first main surface, the first main surface serves as a mounting surface, a lamination direction of the multilayer body and an axial direction of the coil are parallel to the length direction along the mounting surface, a plurality of mark conductor patterns formed on respective primary surfaces of the laminated insulating layers other than the one group, the plurality of mark conductor patterns extending along the respective primary surface to be exposed from the multilayer body and formed also on the first main surface of the multilayer body, thereby forming a plurality of determination marks on the first main surface of the multilayer body, wherein the plurality of determination marks are each composed of one or more lines on the first main surface, are each formed entirely within an area on the first main surface of the multilayer body over which the first outer electrode or the second outer electrode is formed, and are formed in at least two regions, each region containing only one corresponding corner of the first main surface, so as to be symmetric with respect to each other about a central point, the length of the part of the first outer electrode that covers the first main surface of the multilayer body is no less than 0.12 mm and no more than 0.22 mm, and the length of the part of the second outer electrode that covers the first main surface of the multilayer body is no less than 0.12 mm and no more than 0.22 mm.

2. The multilayer coil component according to claim 1, wherein the first outer electrode further extends from the first end surface and the first main surface and covers a part of the first side surface and a part of the second side surface, and the second outer electrode further extends from the second end surface and the first main surface and covers a part of the first side surface and a part of the second side surface.

3. The multilayer coil component according to claim 1, wherein a length of the line is from 0.04 mm to 0.1 mm.

4. A multilayer coil component comprising:

a multilayer body that is formed of laminated insulating layers and that contains a coil, each laminated insulating layer having a respective primary surface; and a first outer electrode and a second outer electrode that are electrically connected to the coil, wherein the coil is formed of coil conductors that are stacked together with the insulating layers and that are electrically connected to each other, the coil conductors each being disposed on respective primary surfaces of one group of the laminated insulating layers, the multilayer body has a first end surface and a second end surface that face away from each other in a length direction, a first main surface and a second main surface that face away from each other in a height direction perpendicular to the length direction, and a first side surface and a second side surface that face away from each other in a width direction perpendicular to the length direction and the height direction, the first outer electrode covers a part of the first end surface, extends from the first end surface, and covers a part of the first main surface, the second outer electrode covers a part of the second end surface, extends from the second end surface, and covers a part of the first main surface, the first main surface serves as a mounting surface, a lamination direction of the multilayer body and an axial direction of the coil are parallel to the length direction along the mounting surface, a plurality of mark conductor patterns formed on respective primary surfaces of the laminated insulating layers other than the one group, the plurality of mark conductor patterns extending along the respective primary surface to be exposed from the multilayer body and formed also on the first main surface of the multilayer body, thereby forming a plurality of determination marks on the first main surface of the multilayer body, wherein the plurality of determination marks are each composed of one or more lines on the first main surface, are each formed entirely within an area on the first main surface of the multilayer body over which the first outer electrode or the second outer electrode is formed, and are formed in at least two regions, each region containing only one corresponding corner of the first main surface, so as to be symmetric with respect to each other about a central point, the multilayer body contains a first connection conductor and a second connection conductor, the first connection conductor linearly connects a part of the first outer electrode that covers the first end surface and one of the coil conductors that faces the part of the first outer electrode to each other, the second connection conductor linearly connects a part of the second outer electrode that covers the second end surface and another of the coil conductors that faces the part of the second outer electrode to each other, the first connection conductor and the second connection conductor overlap the coil conductors in a plan view from the lamination direction and are nearer than a central axis of the coil to the mounting surface, the length of the part of the first outer electrode that covers the first main surface of the multilayer body is no less than 0.12 mm and no more than 0.22 mm, and the length of the part of the second outer electrode that covers the first main surface of the multilayer body is no less than 0.12 mm and no more than 0.22 mm.

5. The multilayer coil component according to claim 4, wherein the first outer electrode further extends from the first end surface and the first main surface and covers a part of the first side surface and a part of the second side surface, and the second outer electrode further extends from the second end surface and the first main surface and covers a part of the first side surface and a part of the second side surface.

6. The multilayer coil component according to claim 5, wherein a length of the line is from 0.04 mm to 0.1 mm.

7. The multilayer coil component according to claim 4, wherein the determination marks are formed in four regions each of which contains a corresponding one of corners of the first main surface.

8. A multilayer coil component comprising:

a multilayer body that is formed of laminated insulating layers and that contains a coil, each laminated insulating layer having a respective primary surface; and a first outer electrode and a second outer electrode that are electrically connected to the coil, wherein the coil is formed of coil conductors that are stacked together with the insulating layers and that are electrically connected to each other, the coil conductors each being disposed on respective primary surfaces of one group of the laminated insulating layers, the multilayer body has a first end surface and a second end surface that face away from each other in a length direction, a first main surface and a second main surface that face away from each other in a height direction perpendicular to the length direction, and a first side surface and a second side surface that face away from each other in a width direction perpendicular to the length direction and the height direction, the first outer electrode covers a part of the first end surface, extends from the first end surface, and covers a part of the first main surface, the second outer electrode covers a part of the second end surface, extends from the second end surface, and covers a part of the first main surface, the first main surface serves as a mounting surface, a lamination direction of the multilayer body and an axial direction of the coil are parallel to the length direction along the mounting surface, and a plurality of mark conductor patterns formed on respective primary surfaces of the laminated insulating layers other than the one group, the plurality of mark conductor patterns extending along the respective primary surface to be exposed from the multilayer body and formed also on the first main surface of the multilayer body, thereby forming a plurality of determination marks on the first main surface of the multilayer body, wherein the plurality of determination marks are each composed of one or more lines on the first main surface, are each formed entirely within an area on the first main surface of the multilayer body over which the first outer electrode or the second outer electrode is formed, and are formed in at least two regions, each region containing only one corresponding corner of the first main surface, so as to be symmetric with respect to each other about a central point, and the determination marks are formed in four regions each of which contains a corresponding one of corners of the first main surface, the length of the part of the first outer electrode that covers the first main surface of the multilayer body is no less than 0.12 mm and no more than 0.22 mm, and the length of the part of the second outer electrode that covers the first main surface of the multilayer body is no less than 0.12 mm and no more than 0.22 mm.

9. The multilayer coil component according to claim 8, wherein a length of the line is from 0.04 mm to 0.1 mm.

* * * * *